United States Patent [19]

Purdum

[11] 4,098,308

[45] Jul. 4, 1978

[54] VAPOR RECOVERING FUEL DISPENSING NOZZLE

[75] Inventor: Charles R. Purdum, Bay Village, Ohio

[73] Assignee: The Standard Oil Company, Cleveland, Ohio

[21] Appl. No.: 693,255

[22] Filed: Jun. 7, 1976

[51] Int. Cl.[2] ..... B65B 3/04

[52] U.S. Cl. ..... 141/285; 141/46; 141/312; 277/34.6

[58] Field of Search ..... 141/46, 59, 287, 312, 141/392, 285; 277/34.3, 34.6; 166/187

[56] References Cited

U.S. PATENT DOCUMENTS

| | | | |
|---|---|---|---|
| 1,988,397 | 1/1935 | Reed | 277/34.6 |
| 3,581,782 | 6/1971 | Onufer | 141/59 |
| 3,845,792 | 11/1974 | Johnson | 141/46 |

*Primary Examiner*—Houston S. Bell

*Attorney, Agent, or Firm*—Herbert D. Knudsen; William D. Mooney

[57] ABSTRACT

The present invention is a fuel dispensing nozzle having an expanding rubber annulus that seals on the inside of a tank filler neck. The seal uses fuel pressure to expand and contract, thereby requiring little operator attention to effect vapor recovery during fuel loading.

4 Claims, 6 Drawing Figures

VAPOR RECOVERING FUEL DISPENSING NOZZLE

BACKGROUND OF THE INVENTION

Recent EPA regulations with respect to vapors emitted during fueling of automobiles, trucks, etc. will require the recovery of these vapors during fuel dispensing. This recovery can be as high as 90% efficiency, or a release of no more than 0.4 grams of vapors per gallon of fuel dispensed.

Several systems have been proposed to recover these vapors during fueling. Among these have been vacuum assisted vapor withdraw and compression refrigeration condensation systems. One problem becomes apparent when considering any vapor recovery system. This is the ability to effect a tight seal between the gasoline or fuel dispensing nozzle and the tank filler neck. To complicate matters, there are no standard dimensions for tank filler necks on present automobiles. In fact, differences in size are required to prevent the addition of leaded fuels into automobiles that require unleaded fuels.

As disclosed in *Vehicle Refueling Emissions Seminar* American Petroleum Institute Publication 4222, several proposals have been put forth to effect this seal. All have so far required extreme operator attention to be effective. One device so disclosed in this publication (page 96) consists of a seal made on the inside of the tank filler neck by an expanding rubber annulus. The seal is made by actuating a lever. The present invention improves on this design by providing means for expanding and contracting this annulus without operator attention to levers, etc., thereby improving reliability of use and simplicity of design.

SUMMARY OF THE INVENTION

The invention is a fuel dispensing nozzle for dispensing fuel into a tank filler neck comprising:

(a) a nozzle, said nozzle having a nozzle spout for insertion into a tank filler neck and having means for regulating a flow of fuel from the nozzle into the tank filler neck;

(b) a restriction, located inside the nozzle spout whereby a back pressure is created in the nozzle spout during fuel dispensing;

(c) a metal sleeve attached to the outside surface of the nozzle spout, having a rear and a leading protector rib, and having holes communicating to the inside surface of the nozzle spout;

(d) an expandable rubber annulus, attached to the metal sleeve of (c) wherein fuel when being dispensed flows thru the holes of the metal sleeve of (c) into and expanding the rubber annulus, thereby effecting a seal between the nozzle spout and inside of the tank filler neck.

In the practice of the invention, the operator has only to insert the fuel dispensing nozzle into the tank filler neck and start the fuel dispensing. The rubber annulus automatically expands during fueling and contracts when fueling has finished. This then provides the tight seal necessary for the various vapor recovery systems being proposed to function.

The central feature of the invention is the use of the fuel pressure to expand the annulus on the fuel nozzle. By utilizing this pressure, little or no attention to the sealing is necessary on the part of the operator, and the sealing system is applicable to the majority of tank filler neck sizes.

The invention is best understood by reference to the drawings.

DESCRIPTION OF THE DRAWINGS

In the drawings:

Referring to FIG. 1, the fuel dispensing valve 1 with nozzle spout 2 and expanding annulus 3 is inserted into a fuel filler pipe 4 shown herein for a typical vehicle. The spout 2 contains a tube 5 for vapor collection shown in greater detail in later figures. The tube 5 travels inside the spout and exits prior to the valve. Tube 5 allows the vapors to bypass the valve, and re-enters the fuel hose 6 to carry the vapors back to the storage tank 7. Inside the fuel pump. tube 5 exits the hose to bypass the fuel pump, thereby allowing an unrestricted flow of vapors back to the storage tank 7.

FIG. 2 is a cross section of the fuel nozzle spout 2 and filler pipe 4 before fuel is dispensed. Referring to the nozzle spout 2, a restriction 8 is placed in the end of the spout to create a back pressure in the spout cavity 9. The spout also contains two tubes 10 and 5. Tube 10 is the Typical shut-off tube which returns to a shut-off mechanism in the valve (not shown). Tube 5 is the vapor removal tube which carries the vapors out of the fuel tank. Attached to the nozzle and shown inside the tank filler neck 4 is the sealing apparatus. This apparatus consists of a metal sleeve 11 shown in greater detail in FIG. 6. The metal sleeve has holes 12 which match with holes in the nozzle spout. Attached over the sleeve 11 and holes 12 is the expandable rubber rubber annulus 3. The holes 12 provide the communicating pathway for the fuel to expand the rubber annulus. Also shown on this sleeve are two protector ribs; a leading rib 13 to protect the annulus during insertion of the nozzle spout into the filler neck, and a rear protecting rib 14 which both protects the annulus on withdrawal of the spout, and also provides the means for holding the nozzle in the filler neck.

FIG. 3 is the nozzle during fuel dispensing. The fuel has entered the rubber annulus 3 through holes 12, thereby expanding it and bringing it in sealing contact with the inside surface of the filler neck 4. Vapors are continuously withdrawn through vapor tube 5. Upon ending fuel dispensing, the elasticity of the rubber annulus 3 and the vacuum action produced by the draining of the fuel out of the nozzle pull the annulus back to the shape shown in FIG. 2 for removal of the nozzle.

FIGS. 4 and 5 are FIGS. 3 and 4 as applied to the dispensing of non-leaded fuels. Federal regulations require different nozzle spout sizes to prevent leaded fuels from being added to non-leaded systems. FIG. 4 shows how the present invention is applicable to these regulations. The nozzle spout 2, immediately after the rubber annulus 3 is offset. The offset section 15 of the spout 2 is the required diameter for insertion into non-leaded fuel systems. Other than this difference, FIG. 4 and FIG. 5 are identical to FIGS. 3 and 4.

FIG. 6 is a cross section of the metal sleeve 11 and rubber annulus 3 that attaches over the nozzle. The metal sleeve 11 is cylindrical, having flanges 16 to support the rear and leading protection ribs, and having holes 12 to allow the fuel to flow into the annulus. The rubber annulus 3 is attached to the sleeve 11 covering the holes 12 and also providing the protector ribs 13 and 14.

Figure 1:
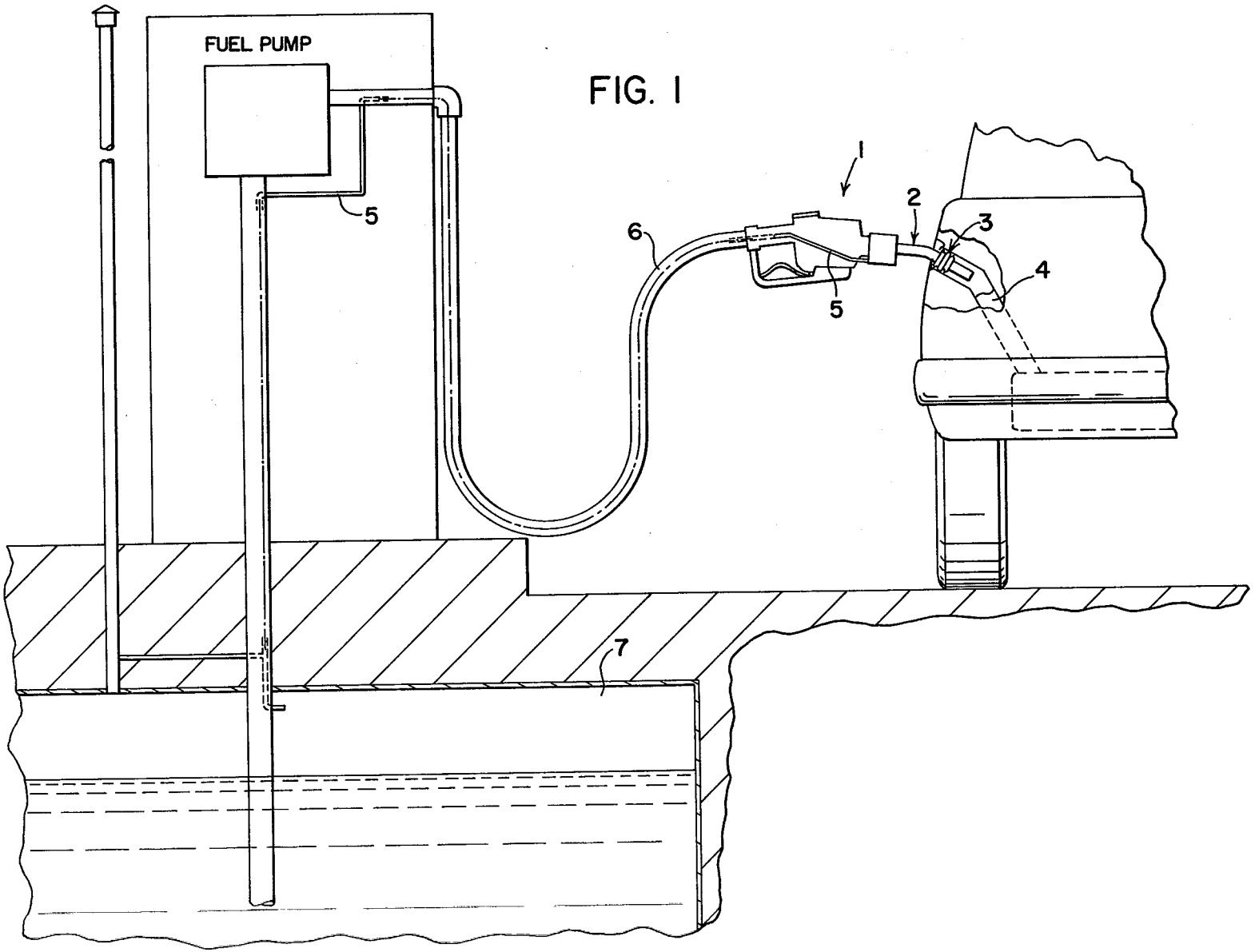
FIG. 1 shows the invention in its contemplated normal use.
Figure 2:
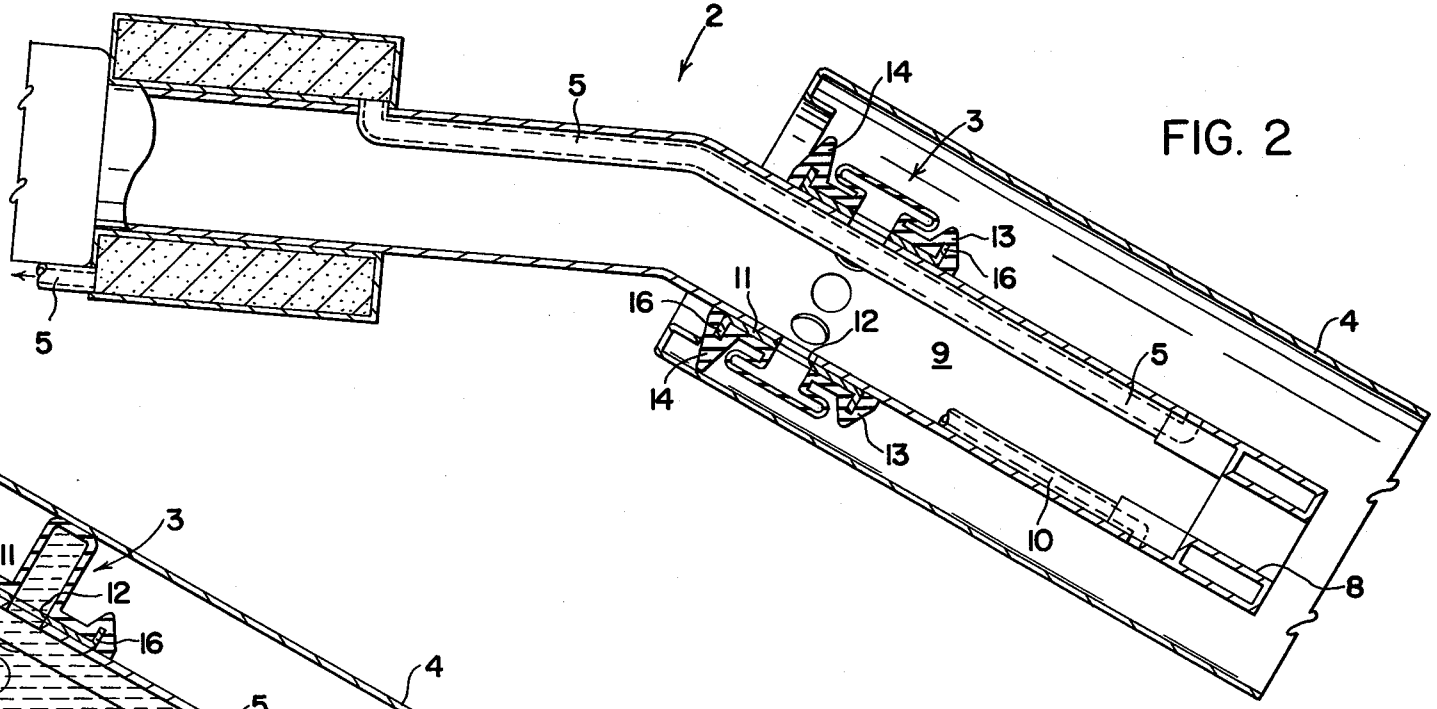
FIG. 2 shows an enlarged sectional view of the nozzle spout with the fuel dispensing nozzle inserted into a fuel filler pipe.
Figure 3:
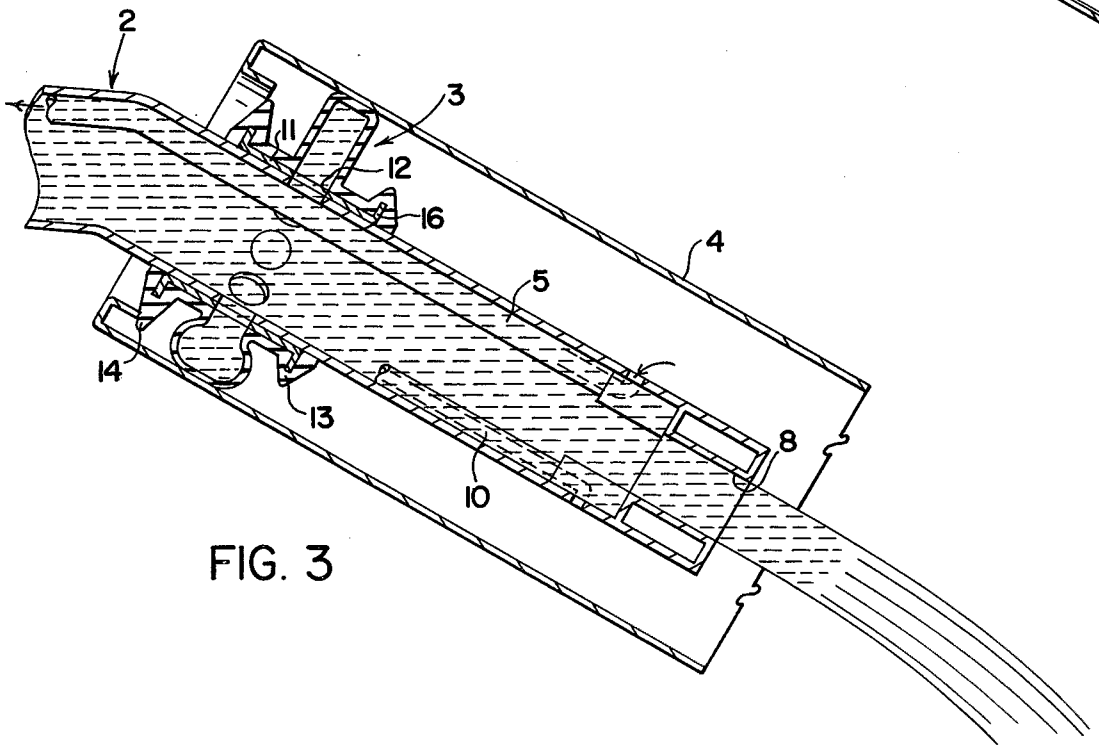
FIG. 3 is an alternate position of FIG. 2 showing the rubber annulus expanded during dispensing, sealing the tank filler neck.
Figure 4:
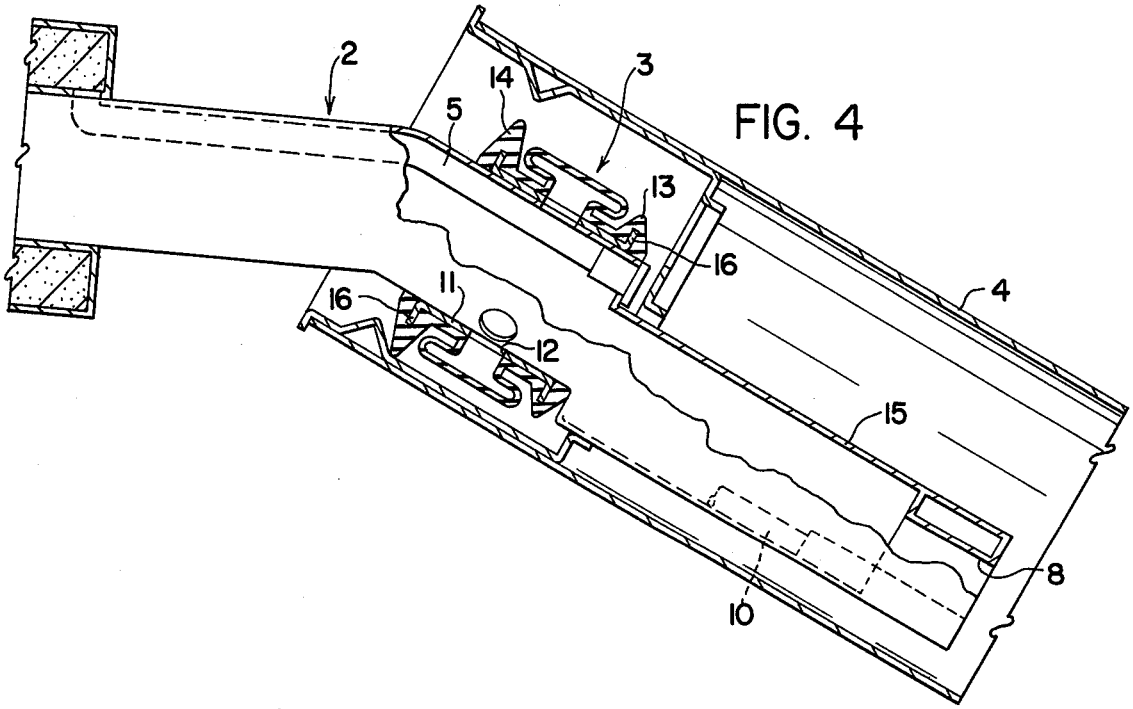
FIG. 4 is a view similar to FIG. 2 showing a modified form, for unleaded fuel tank filler pipes.
Figure 5:
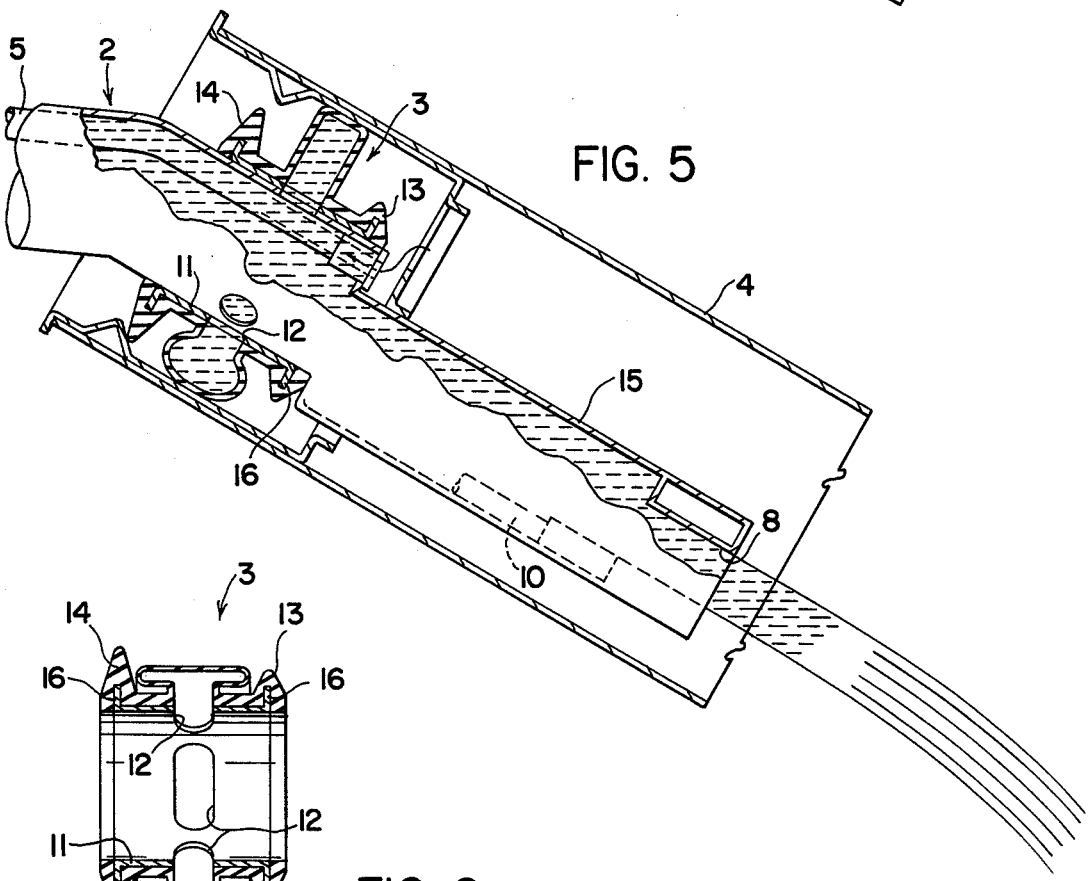
FIG. 5 is an alternate position of FIG. 4 showing the rubber annulus expanded during dispensing and sectional sealing the tank filler neck.
Figure 6:
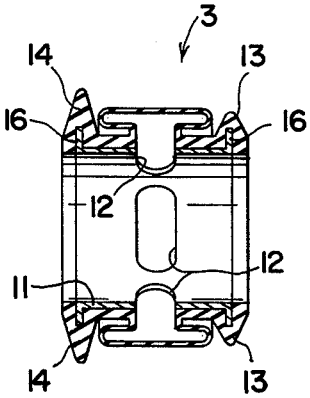
FIG. 6 is a detached view of the attached metal sleeve showing the rubber annulus and communicating holes.

The advantage of the present invention over the art is the elimination of operator attention to fuel dispensing where vapor recovery systems are employed. The expandable annulus disclosed in the *Vehicle Refueling Emission's Seminar,* page 96, requires the seal to be actuated or contracted mechanically by actuating a lever. Other methods disclosed in this publication require a myriad of fittings to adapt to the existing tank filler necks. The present invention provides a safe efficient method for effecting the sealing necessary to recover vapors without placing the effectiveness of the system on the operator.

PREFERRED EMBODIMENT

In the preferred concept of the invention, the sealing apparatus consists of a metal sleeve which fits over the outside of the fuel dispensing nozzle. This sleeve has holes which match holes in the nozzle spout. A hydrocarbons-resistant rubber annulus having an inflatable ring at its central position is molded over the metal sleeve. The fuel, when being dispensed, flows through the holes in the sleeve and expands the annulus, effecting a tight seal.

In a variation of this invention, the rubber annulus may be molded directly on the nozzle spout, eliminating the metal sleeve. The metal sleeve, however, provides means for adapting existing fuel dispensing nozzles to vapor recovery systems.

The metal sleeve and annulus also have two protection ribs. The leading rib protects the expandable part of the annulus during insertion of the nozzle spout. The rear rib protects the annulus during withdrawal of the spout and also provides the means for holding the nozzle in the filler neck.

When fueling, the flow of fuel through the nozzle spout encounters a partial obstruction located at the end of the spout. This obstruction, or restriction, creates a back pressure in the nozzle spout cavity, thereby forcing fuel into the expandable annulus. The size of this restriction will, of course, vary depending on the size of the nozzle and the type of hydrocarbon-resistant rubber used for the annulus. The restriction should be so sized as to provide suitable pressure to expand the annulus and effect the necessary seal.

The fuel vapor displaced by the rising level of fuel is removed by a small tube located inside the nozzle spout and connected through the wall of the spout after the annulus. The tube travels up the inside of the spout and bypasses the automatic nozzle shut-off mechanism. This vapor tube then proceeds along the fuel dispensing hose to the fuel storage tank or any known vapor recovery system. The vapor tube may also contain a flame arrester to prevent fire propagation into the vapor tube.

The size of this vapor will depend on the type of vapor recovery system employed and the amount of vapors being displaced. Preferred is a tubing size between 7/32 to ⅜ inches. The larger size provides the least pressure drop back to the recovery system. If a vacuum assisted vapor recovery system is employed, this tubing size will decrease. The present invention is applicable to any known vapor handling system.

When fueling is completed, the nozzle's shut-off mechanism closes, and the pressure in the nozzle spout decreases, allowing the inflatable annulus to recover its original shape. A further vacuum action produced by gravitational evacuation of fuel from the nozzle pulls the inflatable annulus against the metal sleeve's periphery, freeing the nozzle from the fill pipe.

The nozzle shut-off mechanism may be any type known in the art. It may consist of another tube inside the nozzle spout going to a pressure actuating device, or may be sensors mounted on the end of the nozzle to detect the back-up of liquid fuel.

The nozzle spout may also be offset and reduced in size to be applicable to non-leaded fuel tanks. The metal sleeve with annulus is located prior to this offset and/or reduction in size, but still inside the tank filler neck.

The present invention thus provides an automatic easy operation for use with vapor recovery systems to meet requirements of minimal vapor emissions during fueling.

We claim:

1. A dispensing nozzle for dispensing fuel into a tank filler neck, said dispensing nozzle having a dispensing conduit, an expandable annulus on said conduit for effecting a seal between the conduit and the inside surface of the tank filler neck, said annulus defining with said dispensing conduit a continuously closed chamber for receiving fuel and thereby expanding said annulus, said dispensing conduit defining in the side walls thereof at least one hole communicating with said closed chamber whereby said annulus can be expanded by the flow of fuel through said dispensing conduit only, said annulus located on said conduit so that said annulus can be completely received in said neck when fuel is dispensed.

2. The fuel dispensing nozzle of claim 1 wherein a tube is located inside the nozzle to recover vapors released during fueling.

3. The fuel dispensing nozzle of claim 1 comprising:

(a) a nozzle, said nozzle having a nozzle spout for insertion into a tank filler neck and having means for regulating a flow of fuel from the nozzle into the tank filler neck;

(b) a restriction, located inside the nozzle spout, whereby a back pressure is created in the nozzle spout during fuel dispensing;

(c) a metal sleeve attached to the outside surface of the nozzle spout, having a rear and a leading protector rib, and having holes communicating to the inside surface of the nozzle spout;

(d) an expandable annulus, attached to the metal sleeve of (c) so that said annulus can be completely received in said neck, wherein fuel when being dispensed flows thru the holes of the metal sleeve of (c) into and expanding the rubber annulus, thereby effecting a seal between the nozzle spout and inside of the tank filler neck.

4. The fuel dispensing nozzle of claim 3 wherein a tube is located inside the nozzle spout to recover vapors released during fueling.

* * * * *